US011029617B2

(12) United States Patent
Chimoto et al.

(10) Patent No.: US 11,029,617 B2
(45) Date of Patent: Jun. 8, 2021

(54) WHITE TONER AND METHOD FOR PRODUCING SAME

(71) Applicant: CANON KABUSHIKI KAISHA, Tokyo (JP)

(72) Inventors: Yuya Chimoto, Funabashi (JP); Kouichirou Ochi, Chiba (JP); Hayato Ida, Toride (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/815,355

(22) Filed: Mar. 11, 2020

(65) Prior Publication Data

US 2020/0301301 A1 Sep. 24, 2020

(30) Foreign Application Priority Data

Mar. 18, 2019 (JP) ..... JP2019-050161

(51) Int. Cl.

| | |
|---|---|
| ***G03G 9/08*** | (2006.01) |
| ***G03G 9/097*** | (2006.01) |
| ***G03G 9/09*** | (2006.01) |
| ***G03G 9/087*** | (2006.01) |

(52) U.S. Cl.

CPC ..... *G03G 9/09791* (2013.01); *G03G 9/081* (2013.01); *G03G 9/0821* (2013.01); *G03G 9/08755* (2013.01); *G03G 9/0902* (2013.01); *G03G 9/09716* (2013.01)

(58) Field of Classification Search

CPC ..... G03G 9/09791; G03G 9/09708; G03G 9/09716; G03G 9/0821; G03G 9/0902; G03G 9/08755

USPC ..... 430/108.3, 108.1

See application file for complete search history.

(56) References Cited

U.S. PATENT DOCUMENTS

| | | | |
|---|---|---|---|
| 7,833,687 | B2 | 11/2010 | Kato et al. |
| 8,697,327 | B2 | 4/2014 | Shibata et al. |
| 9,057,970 | B2 | 6/2015 | Ida et al. |
| 9,348,247 | B2 | 5/2016 | Ida et al. |
| 9,540,483 | B2 | 1/2017 | Ida et al. |
| 9,696,644 | B2 | 7/2017 | Ida et al. |
| 9,897,934 | B2 | 2/2018 | Tamura et al. |
| 10,012,920 | B2 | 7/2018 | Shibata et al. |
| 10,078,281 | B2 | 9/2018 | Ida et al. |
| 10,088,765 | B2 | 10/2018 | Miyakai et al. |
| 10,175,595 | B2 | 1/2019 | Onozaki et al. |
| 10,197,936 | B2 | 2/2019 | Onozaki et al. |
| 10,203,619 | B2 | 2/2019 | Yamashita et al. |
| 10,228,629 | B2 | 3/2019 | Tamura et al. |
| 10,451,990 | B2 | 10/2019 | Kamae et al. |
| 10,514,624 | B2 | 12/2019 | Tamura et al. |
| 2013/0108955 | A1 | 5/2013 | Shibata et al. |
| 2015/0099227 | A1 | 4/2015 | Ida et al. |
| 2019/0384193 | A1 | 12/2019 | Hashimoto et al. |
| 2019/0384196 | A1 | 12/2019 | Kamae et al. |
| 2019/0384202 | A1 | 12/2019 | Shirayama et al. |
| 2020/0057397 | A1 | 2/2020 | Murayama et al. |

FOREIGN PATENT DOCUMENTS

| | | |
|---|---|---|
| JP | 2000-056514 | 2/2000 |

OTHER PUBLICATIONS

Harazaki, "Basic Coating Science" (1986) (English Translation of pp. 55-56, Table 3-9).
U.S. Appl. No. 16/534,343, Kentaro Kamae, filed Aug. 7, 2019.
U.S. Appl. No. 16/794,925, Kouichirou Ochi, filed Feb. 19, 2020.
U.S. Appl. No. 16/902,365, Yuya Chimoto, filed Jun. 16, 2020.

*Primary Examiner* — Mark A Chapman
(74) *Attorney, Agent, or Firm* — Venable LLP

(57) ABSTRACT

A white toner comprising a toner particle including a binder resin, an inorganic white pigment, and a polyvalent metal salt compound, wherein the inorganic white pigment has an acidic group at a surface thereof; an amount of the inorganic white pigment in the toner particle is 10% to 50% by volume; the polyvalent metal salt compound is a specific compound; an absolute value of the difference between an SP value $(J/cm^3)^{1/2}$ of the binder resin and that of the polyvalent metal salt compound is 0.0 to 6.0; and an amount of the polyvalent metal salt compound, an amount of a polyvalent metal, the amount of the inorganic white pigment, and an amount of the acidic group at a surface of the inorganic white pigment satisfy a specific relationship.

12 Claims, No Drawings

WHITE TONER AND METHOD FOR PRODUCING SAME

BACKGROUND OF THE INVENTION

Field of the Invention

The present invention relates to a white toner for use in an electrophotographic image forming method, and a method for producing the same.

Description of the Related Art

In recent years, with the development of image forming apparatuses such as copiers and printers, a demand has been created for toners adaptable to various media. Among them, a technique for obtaining a high value-added printed matter using a special color toner such as a transparent toner or a white toner has been developed.

A white toner is important for forming a white image on colored paper or a transparent film, and a toner using a material having a high refractive index such as titanium oxide has been developed, as disclosed in, for example, Japanese Patent Application Publication No. 2000-56514, to achieve high concealing property.

SUMMARY OF THE INVENTION

Usually, in order to form a white image using a white toner and express a sufficient white color, it is preferable to conceal the underlying color and make it unrecognizable. Since such an image concealing property is manifested by the scattering of light in the image film, a colorless pigment with a large difference in refractive index with a binder resin, that is, a material having a high refractive index, is needed. Further, in order to exhibit sufficient concealing property, it is preferable that the above-mentioned white pigment be contained in the toner particle of a white toner in a larger amount and with better dispersibility than other colors.

However, it has been found that when a large amount of a white pigment such as titanium oxide is included in the toner, bending resistance of a fixed image decreases due to an increase in the area of the interface between the binder resin and the pigment having low interaction. To solve this problem, it is possible to improve the bending resistance by using a high-molecular-weight resin having a large amount of a crosslinking component. However, it has been found that since the viscosity of the toner is increased, the dispersibility of the white pigment is reduced, and the concealing property of the image is reduced.

The present invention provides a white toner having excellent bending resistance and concealing property in order to solve such a problem.

As a result of extensive studies conducted by the present inventors, it has been found that the above problem can be solved by including a binder resin, a white pigment having specific surface properties, and a polyvalent metal salt compound having a specific structure in a toner particle.

The polyvalent metal salt compound has a polyvalent metal salt segment and an organic group. It is considered that due to the presence of the polyvalent metal salt compound in the toner particle, the polyvalent metal salt segment of the polyvalent metal salt compound interacts with the acidic group on the white pigment surface, and the organic group of the polyvalent metal salt compound interacts with the binder resin, thereby enhancing the interaction between the binder resin and the white pigment. It is considered that the above-mentioned interaction is maintained even after the fixing step in the electrophotographic process, and as a result, the bending resistance of the image is improved.

That is, one aspect of the present invention is a white toner comprising a toner particle that includes a binder resin, an inorganic white pigment and a polyvalent metal salt compound, wherein the inorganic white pigment has an acidic group at a surface thereof, and a volume amount of the inorganic white pigment in the toner particle is 10% by volume to 50% by volume;

the polyvalent metal salt compound is at least one selected from the group consisting of compounds represented by following formulae (1) and (2):

in the following formula (1), $R^1$ is each independently an organic group having from 6 to 40 carbon atoms, $M^1$ is a divalent metal, $X^1$ is a hydroxyl group or a halogen group, $p^1$ represents an integer of 1 to 2, and $q^1$ represents an integer of 0 to 1, in the following formula (2), $R^2$ is each independently an organic group having 6 to 40 carbon atoms, $M^2$ is a trivalent metal, $X^2$ is each independently a hydroxyl group or a halogen group, $p^2$ represents an integer of 1 to 3, and $q^2$ represents an integer of 0 to 2, an absolute value of the difference between an SP value $(J/cm^3)^{1/2}$ of the binder resin and the SP value $(J/cm^3)^{1/2}$ of the polyvalent metal salt compound is 0.0 to 6.0;

wherein when an amount of the polyvalent metal salt compound in the toner particle is denoted by Wa (% by mass), an amount of a polyvalent metal in the polyvalent metal salt compound is denoted by Ma (μmol/g), a mass amount of the inorganic white pigment in the toner particle is denoted by Wp (% by mass), and an amount of the acidic group at the surface of the inorganic white pigment is denoted by Ap (μmol/g), the following is satisfied:

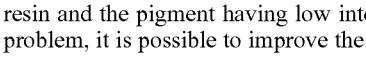

(1)

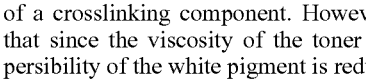

(2)

$$0.1 \leq (Wa \times Ma)/(Wp \times Ap) \leq 2.0.$$

It is possible to provide a white toner having excellent bending resistance and concealing property.

Further features of the present invention will become apparent from the following description of exemplary embodiments.

DESCRIPTION OF THE EMBODIMENTS

The expression "from XX to YY" or "XX to YY" representing the numerical range means a numerical range including a lower limit and an upper limit which are end-points unless otherwise specified.

The toner includes a toner particle. The toner particle includes a binder resin, an inorganic white pigment, and a polyvalent metal salt compound. Hereinafter, each component will be described.

Binder Resin

The toner particle includes a binder resin. Known polymers can be used for the binder resin, and specifically, for example, the following polymers can be used:

monopolymers of styrenes and substituted forms thereof such as polystyrene, poly-p-chlorostyrene and polyvinyltoluene; styrene copolymers such as styrene-p-chlorostyrene copolymer, styrene-vinyltoluene copolymer, styrene-vinylnaphthalene copolymer, styrene-acrylate ester copolymers, styrene-methacrylate ester copolymers, styrene-α-chloromethyl methacrylate copolymer, styrene-acrylonitrile copolymer, styrene-vinyl methyl ether copolymer, styrene-vinyl ethyl ether copolymer, styrene-vinyl methyl ketone copolymer and styrene-acrylonitrile-indene copolymer; and polyvinyl chloride, phenol resin, natural resin-modified phenol resin, natural resin-modified maleic acid resin, acrylic resin, methacrylic resin, polyvinyl acetate, silicone resin, polyester resin, polyurethane resin, polyamide resin, furan resin, epoxy resin, xylene resin, polyvinylbutyral, terpene resin, coumarone-indene resin and petroleum-based resin.

These resins may be used alone or in combination of two or more.

Among them, the binder resin preferably includes a polyester resin, and more preferably is a polyester resin. It is considered that since the polyester resin has a high affinity for the inorganic white pigment and, as a result, disperses the inorganic white pigment satisfactorily, both the concealing property and the bending resistance are easily achievable.

The polyester resin is preferably a condensation polymer of an alcohol component and an acid component. The following compounds are examples of monomers for forming the polyester resin.

Examples of the alcohol component include the following dialcohol components which are dihydric.

Ethylene glycol, propylene glycol, 1,3-butanediol, 1,4-butanediol, 2,3-butanediol, diethylene glycol, triethylene glycol, 1,5-pentanediol, 1,6-hexanediol, neopentyl glycol, 2-ethyl-1,3-hexanediol, hydrogenated bisphenol A, bisphenols represented by the following formula (I) and derivatives thereof, and diols represented by the following formula (II).

Trihydric or higher polyhydric alcohols such as 1,2,3-propanetriol, trimethylolpropane, hexanetriol, and pentaerythritol may also be used as the alcohol component.

(I)

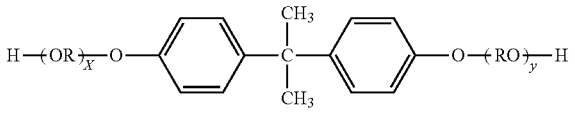

(In the formula, R represents an ethylene group or a propylene group, X and Y are each an integer of 0 or more, and the average value of X+Y is from 0 to 10.)

(II)

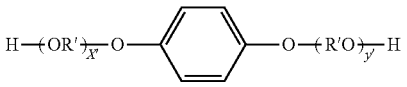

In the formula, R' represents:

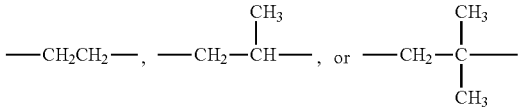

x' and y' are each an integer of 0 or more, and the average value of x'+y' is from 0 to 10.

As the alcohol component, a bisphenol represented by the formula (I) is preferable, and alkylene (ethylene or propylene) oxide adducts of bisphenol A, such as polyoxypropylene(2.2)-2,2-bis(4-hydroxyphenyl)propane, polyoxypropylene(3.3)-2,2-bis(4-hydroxyphenyl)propane, polyoxyethylene(2.0)-2,2-bis(4-hydroxyphenyl)propane, polyoxyethylene(2.2)-2,2-bis(4-hydroxyphenyl)propane, polyoxypropylene(2.0)-polyoxyethylene (2.0)-2,2-bis(4-hydroxyphenyl)propane, and polyoxypropylene(6)-2,2-bis(4-hydroxyphenyl)propane are more preferable.

Examples of the acid component include the following divalent carboxylic acids.

Benzenedicarboxylic acids or anhydrides thereof such as phthalic acid, terephthalic acid, isophthalic acid, and phthalic anhydride; alkyl dicarboxylic acids such as succinic acid, adipic acid, sebacic acid, and azelaic acid or anhydrides thereof; succinic acid or an anhydride thereof substituted with an alkyl group having from 6 to 18 carbon atoms or an alkenyl group having from 6 to 18 carbon atoms; and unsaturated dicarboxylic acids such as fumaric acid, maleic acid, citraconic acid, and itaconic acid, or anhydrides thereof.

It is also preferable to use a trivalent or higher polycarboxylic acid for the acid component. Examples thereof include 1,2,4-benzenetricarboxylic acid (trimellitic acid), 1,2,4-cyclohexanetricarboxylic acid, 1,2,4-naphthalenetricarboxylic acid, pyromellitic acid and acid anhydrides or lower alkyl esters thereof.

The alcohol component preferably includes a propylene oxide adduct of bisphenol A. In the structure derived from the dialcohol component (the structure in which the dialcohol component is condensed) contained in the polyester resin, the amount of the structure derived from the propylene oxide adduct of bisphenol A (the condensed structure) is preferably 50% by mass to 100% by mass, and more preferably 70% by mass to 100% by mass. It is considered that when the amount is within the above range, the affinity between the polyvalent metal salt compound and the binder resin is improved, and the bending resistance is improved.

From the viewpoint of concealing property and bending resistance, the amount of the binder resin in the toner particle is preferably 30% by volume to 90% by volume, and more preferably 40% by volume to 80% by volume.

Inorganic White Pigment

The toner particle includes an inorganic white pigment. Examples of the inorganic white pigment include titanium oxide, magnesium oxide, aluminum oxide, zinc oxide, barium sulfate, calcium carbonate, calcium titanate, silica, clay, and talc. These white pigments may be surface-treated.

Titanium oxide, zinc oxide and calcium titanate are preferred. Titanium oxide and calcium titanate are more preferable because they have a high refractive index and, as a result, have a high concealing property.

The volume amount of the inorganic white pigment in the toner particle is 10% by volume to 50% by volume. Preferably, the amount is 20% by volume to 40% by volume.

Within this range, both the concealing property and the bending resistance can be achieved.

The inorganic white pigment has an acidic group at a surface thereof. The amount of the acidic group Ap at a surface of the inorganic white pigment is preferably 10 μmol/g to 150 μmol/g, and more preferably 20 μmol/g to 100 μmol/g.

Polyvalent Metal Salt Compound

The toner particle includes a polyvalent metal salt compound. The polyvalent metal salt compound is a compound including a polyvalent metal salt segment and an organic group, and is at least one selected from the group consisting of compounds represented by the formulas (1) and (2).

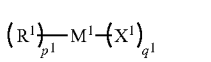

(1)

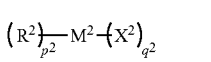

(2)

(In the formula (1), $R^1$ is each independently an organic group having 6 to 40 carbon atoms, $M^1$ is a divalent metal, $X^1$ is a hydroxyl group or a halogen group (preferably a hydroxyl group), $p^1$ represents an integer of 1 to 2, and $q^1$ represents an integer of 0 to 1.

In the formula (2), $R^2$ is each independently an organic group having 6 to 40 carbon atoms, $M^2$ is a trivalent metal, $X^2$ is each independently a hydroxyl group or a halogen group (preferably a hydroxyl group), $p^2$ represents an integer of 1 to 3 (preferably 2 or 3, more preferably 2), and $q^2$ represents an integer of 0 to 2 (preferably 0 or 1, more preferably 1).)

The organic group is a group in which a hydrocarbon group bonds to a linking group that bonds to a polyvalent metal ($M^1$ or $M^2$) to form a salt. The hydrocarbon group represents such as a linear or branched alkyl group, a linear or branched alkenyl group, a phenyl group, or a naphthyl group. The example of the linking group is such as —C(=O)—O— or —S(=O)$_2$O—. The hydrocarbon group may be unsubstituted or substituted with a functional group (for example, a hydroxyl group, an amino group, a halogen group, a carboxy group, etc.). The organic group is preferably an acyloxy group having 6 to 40 carbon atoms or an alkyl sulfonyloxy group having 6 to 40 carbon atoms.

It is preferable that the polyvalent metal salt compound be at least one selected from the group consisting of compounds represented by formulas (3) and (4).

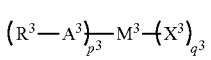

(3)

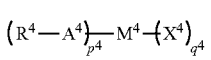

(4)

(In the formula (3), $R^3$ is each independently an unsubstituted or hydroxyl-substituted alkyl group having 8 to 30 (preferably 10 to 20) carbon atoms, or a phenyl group which may be unsubstituted or substituted with an alkyl group having 1 to 8 carbon atoms, $A^3$ is independently —C(=O)—O— or —S(=O)$_2$O—, $M^3$ is a divalent metal, $X^3$ is a hydroxyl group or a halogen group (preferably a hydroxyl group), $p^3$ represents an integer of 1 to 2, and $q^3$ represents an integer of 0 to 1.

In the formula (4), $R^4$ is each independently an unsubstituted or hydroxyl-substituted alkyl group having 8 to 30 (preferably 10 to 20) carbon atoms, or a phenyl group which may be unsubstituted or substituted with an alkyl group having 1 to 8 carbon atoms, $A^4$ is independently —C(=O)—O— or —S(=O)$_2$O—, $M^4$ is a trivalent metal, $X^4$ is a hydroxyl group or a halogen group (preferably a hydroxyl group), $p^4$ represents an integer of 1 to 3 (preferably 2 or 3, more preferably 2), and $q^4$ represents an integer of 0 to 2 (preferably 0 or 1, more preferably 1).)

Furthermore, the polyvalent metal salt compound is preferably a fatty acid metal salt. For example, $R^1$ and $R^2$ are preferably an acyloxy group having 8 to 30 (more preferably 10 to 20) carbon atoms or an alkyl sulfonyloxy group having 8 to 30 (more preferably 10 to 20) carbon atoms, and $R^3$ and $R^4$ are preferably an alkyl group having 8 to 30 (preferably 10 to 20) carbon atoms. Further, $M^1$ and $M^3$ are preferably calcium, and $M^2$ and $M^4$ are preferably aluminum. The polyvalent metal salt compound is particularly preferably a fatty acid aluminum salt. Since such a compound easily interacts with the resin and the inorganic white pigment, the bending resistance is improved.

For example, at least one selected from the group consisting of hydroxyaluminum distearate, hydroxyaluminum dioctylate, hydroxyaluminum dilaurate, hydroxyaluminum dimontanate and calcium 12-hydroxydistearate is preferable, and at least one selected from the group consisting of hydroxyaluminum distearate and hydroxyaluminum dilaurate is more preferable.

The amount Wa of the polyvalent metal salt compound in the toner particle is preferably 0.1% by mass to 10.0% by mass, and more preferably 0.5% by mass to 5.0% by mass.

An SP value $(J/cm^3)^{1/2}$ of the polyvalent metal salt compound is preferably 15.0 to 30.0, and more preferably 15.0 to 25.0. Within this range, the polyvalent metal salt compound easily interacts with the binder resin, so that the bending resistance is improved.

The SP value can be obtained using the Fedors equation.

$$\delta i=[Ev/V]^{1/2}=[\Delta ei/\Delta vi]^{1/2}$$

Ev: evaporation energy

V: molar volume

Δei: evaporation energy of the atom or atomic group of the i component

Δvi: molar volume of the atom or atomic group of the i component

The values of Δei and Δvi refer to the evaporation energies and molar volumes (25° C.) of atoms and atomic groups according to Table 3-9 of "Basic Coating Science", pp. 54-57, 1986 (published by Maki Shoten). Further, in the present invention, the SP value of the polyvalent metal salt compound is calculated by taking a hydrogen atom as the metal atom.

An absolute value of the difference between the SP value $(J/cm^3)^{1/2}$ of the binder resin and the SP value $(J/cm^3)^{1/2}$ of the polyvalent metal salt compound is 0.0 to 6.0, preferably 0.0 to 4.0. Within these ranges, the polyvalent metal salt compound and the binder resin easily interact with each other, so that the bending resistance is improved.

Where an amount of the polyvalent metal salt compound in the toner particle is denoted by Wa (% by mass), an amount of a polyvalent metal in the polyvalent metal salt compound is denoted by Ma (μmol/g), a mass amount of the inorganic white pigment in the toner particle is denoted by Wp (% by mass), and an amount of an acidic group at a surface of the inorganic white pigment is denoted by Ap (μmol/g), the following needs to be satisfied:

$$0.1 \leq (Wa \times Ma)/(Wp \times Ap) \leq 2.0,$$

preferably $$0.5 \leq (Wa \times Ma)/(Wp \times Ap) \leq 1.5.$$

In the above formula, (Wa×Ma) represents the number of moles of the polyvalent metal derived from the polyvalent metal salt compound contained in the toner particle unit amount, and (Wp×Ap) represents the amount of surface acidic groups of the inorganic white pigment contained in the toner particle unit amount. That is, (Wa×Ma)/(Wp×Ap) represents the ratio of the number of moles of the polyvalent metal derived from the polyvalent metal salt compound to the amount of the surface acidic groups of the inorganic white pigment. When this value is in the above range, the affinity between the polyvalent metal salt compound and the inorganic white pigment becomes appropriate, and the bending resistance is improved.

The amount Ma of the polyvalent metal in the polyvalent metal salt compound is preferably 1000 μmol/g to 3500 μmol/g, and more preferably 1500 μmol/g to 2500 μmol/g.

The mass amount Wp of the inorganic white pigment in the toner particle is preferably 30% by mass to 80% by mass, and more preferably 40% by mass to 70% by mass.

Release Agent

The toner may include a release agent as needed. Examples of the release agent are presented hereinbelow.

Low-molecular-weight polyolefins such as polyethylene; silicones having a melting point (softening point) upon heating; fatty acid amides such as oleamide, erucamide, ricinoleamide, and stearamide; ester waxes such as stearyl stearate; vegetable waxes such as carnauba wax, rice wax, candelilla wax, wood wax, and jojoba oil; animal waxes such as beeswax; mineral and petroleum waxes such montan wax, ozokerite, ceresin, paraffin wax, microcrystalline wax, Fischer-Tropsch wax, and ester waxes; and modified products thereof.

The amount of the release agent is preferably from 1 part by mass to 25 parts by mass based on 100 parts by mass of the binder resin.

The melting point of the release agent is preferably from 50° C. to 100° C., and more preferably from 70° C. to 100° C.

Method for Producing Toner

A method for producing the toner is not particularly limited, and a known method such as an emulsion aggregation method, a pulverization method, and a suspension polymerization method can be used. Among these, the pulverization method is preferable. That is, the toner is preferably a melt-kneaded pulverized toner.

Hereinafter, as an example, a procedure for producing a toner by a pulverization method will be described.

Preferably, the method for producing a toner includes the steps of:

melt-kneading a mixture including a binder resin, an inorganic white pigment, and a polyvalent metal salt compound to obtain a melt-kneaded product, and pulverizing the obtained melt-kneaded product to obtain a toner particle.

Firstly, the starting materials for the toner particle, for example, the binder resin, the inorganic white pigment, and the polyvalent metal salt compound and other optional components such as the wax, charge control agent, and so forth, are metered out in prescribed amounts and are blended and mixed. The mixing apparatus can be exemplified by the double-cone mixer, V-mixer, drum mixer, Supermixer, Henschel mixer, Nauta mixer, Mechano Hybrid (Nippon Coke & Engineering Co., Ltd.), and so forth.

The mixed material is then melt-kneaded. The melt-kneading step can use a batch kneader such as a pressure kneader or a Banbury mixer or can use a continuous kneader. Single-screw and twin-screw extruders are preferable for the advantage they offer of enabling continuous production. The temperature of the melt-kneading is preferably 100° C. to 200° C.

Examples in this regard are the KTK twin-screw extruder (Kobe Steel, Ltd.), TEM twin-screw extruder (Toshiba Machine Co., Ltd.), PCM kneader (Ikegai Corp.), Twin Screw Extruder (KCK), Co-Kneader (Buss), and Kneadex (Nippon Coke & Engineering Co., Ltd.). The resin composition yielded by melt-kneading may be rolled using, for example, a two-roll mill, and may be cooled in a cooling step using, for example, water.

The cooled resin composition is then pulverized in a pulverization step to a desired particle diameter. In the pulverization step, for example, a coarse pulverization is performed using a grinder such as a crusher, hammer mill, or feather mill, followed by a fine pulverization using, for example, a pulverizer such as a Kryptron System (Kawasaki Heavy Industries, Ltd.), Super Rotor (Nisshin Engineering Inc.), or Turbo Mill (Turbo Kogyo Co., Ltd.) or using an air jet system.

The classified product (toner particle) is then obtained as necessary by carrying out classification using a sieving apparatus or a classifier, e.g., an internal classification system such as the Elbow Jet (Nittetsu Mining Co., Ltd.) or a centrifugal classification system such as the Turboplex (Hosokawa Micron Corporation), TSP Separator (Hosokawa Micron Corporation), or Faculty (Hosokawa Micron Corporation).

The obtained a toner particle may be directly used as a toner. If necessary, an external additive may be externally added to the surface of the toner particle to form a toner. As a method of externally adding an external additive, predetermined amount of a toner particle and various known external additives are blended, and stirring and mixing is performed using a mixing device such as a double-cone mixer, a V-type mixer, a drum mixer, a SUPER mixer, a Henschel mixer, a NAUTA mixer, a MECHANOHYBRID (manufactured by Nippon Coke Industry Co., Ltd.) or NOBILTA (manufactured by Hosokawa Micron Corporation) as an external addition device.

The volume-based median diameter of the toner is preferably from 3.0 μm to 30.0 μm, and more preferably from 4.0 μm to 20.0 μm.

Hereinafter, methods for measuring physical properties related to the present invention will be described.

Measurement of Amount and Determination of Structure of Polyvalent Metal Salt Compound in Toner Particle A total of 160 g of sucrose (manufactured by Kishida Chemical Co., Ltd.) is added to 100 mL of ion exchanged water and dissolved by heating with a water bath to prepare a sucrose concentrate. Then, 31 g of the sucrose concentrate and 6 mL of CONTAMINON N (10-mass % aqueous solution of neutral detergent for washing precision measuring instruments that includes a nonionic surfactant, an anionic surfactant and an organic builder and has a pH of 7; manufactured by Wako Pure Chemical Industries, Ltd.) are placed in a centrifuge tube to prepare a dispersion liquid.

A total of 1.0 g of the toner is added to the dispersion liquid and lumps of the toner are loosened with a spatula or the like. The centrifuge tube is shaken with a shaker. After shaking, the solution is transferred to a glass tube for a swing rotor (50 mL), and separation is performed under the conditions of 3500 rpm and 30 min with a centrifuge.

This operation separates the toner particle and the separated external additives. After visual confirmation that the toner and the aqueous solution have been sufficiently separated, the toner particle is collected and filtered with a vacuum filter and then dried with a dryer for 1 h or more to obtain a toner particle from which the external additive has been separated.

Further, the obtained a toner particle are dissolved with a solvent such as tetrahydrofuran, toluene, and hexane to dissolve and separate the inorganic white pigment and soluble components other than the polyvalent metal salt compound. The polyvalent metal salt compound is extracted with a heated solvent such as xylene and toluene, and the filtrate is concentrated and dried to separate the polyvalent metal salt compound. The amount of the separated compound is measured.

The structure of the obtained polyvalent metal salt compound is determined using nuclear magnetic resonance spectroscopy (NMR), infrared spectroscopy (IR), and X-ray fluorescence measurement. The SP value can be calculated based on the determined structure by the above-described method.

Measurement of Polyvalent Metal Amount Ma in Polyvalent Metal Salt Compound in Toner Particle After the polyvalent metal salt compound has been extracted by the above-described method, quantitative determination is performed by X-ray fluorescence measurement or ICP emission analysis.

Measurement of Binder Resin Amount in Toner Particle and Determination of Structure The binder resin is dissolved using a solvent such as tetrahydrofuran from the toner particle from which the external additives have been separated by the above-described method, followed by filtration and extraction of the filtrate. The filtrate is centrifuged and then concentrated and dried to measure the amount of the binder resin.

The structure of the binder resin is determined using nuclear magnetic resonance (NMR) or pyrolysis gas chromatography. The SP value can be calculated based on the determined structure by the above-described method.

Measurement of Inorganic White Pigment Amount in Toner Particle

The inorganic white pigment and the polyvalent metal salt compound are separated from the toner particle from which the external additives have been separated by the above-described method, and the polyvalent metal salt compound is further extracted with a heated solvent such as xylene or toluene. The amount of the remaining inorganic white pigment is measured.

The procedure for calculating the amount in % by volume from the obtained inorganic white pigment can involve, for example, using a true specific gravity meter to measure the true specific gravity of the extracted inorganic white pigment, and calculating the amount in % by volume from the mass and the true specific gravity of the inorganic white pigment.

Measurement of Surface Acidic Group Amount at a surface of Inorganic White Pigment The measurement is performed by the following titration method.

(1) A total of 2 g of an inorganic white pigment is added to 30 ml of a 0.01 mol/L potassium hydroxide/ethanol solution.

(2) After subjecting the solution to ultrasonic treatment (25° C., 1 h), the inorganic white pigment and the supernatant are separated by centrifugation.

(3) A total of 10 ml of the supernatant is extracted and diluted 20-fold with ethanol, then potentiometric titration of the supernatant is performed with a 0.01 mol/L hydrochloric acid/ethanol solution by using an automatic potentiometric titrator (AT-510, manufactured by Kyoto Electronics Industry Co., Ltd.), and the amount $A_1$ [ml] of the hydrochloric acid/ethanol solution required for neutralization is determined.

(4) The 0.01 mol/L potassium hydroxide/ethanol solution used in (1) is subjected to potentiometric titration with a 0.01 mol/L hydrochloric acid/ethanol solution and the amount $A_0$ [ml] of the hydrochloric acid/ethanol solution required for neutralization is determined.

(5) Using the following formula, the surface acidic group amount Ap [μmol/g] at a surface of the inorganic white pigment is determined.

$$Ap=(A_0-A_1)\times B/M$$

M: mass of inorganic white pigment in (1) [g]
B: addition amount of potassium hydroxide/ethanol solution in (1) [ml]

EXAMPLES

Hereinafter, the present invention will be specifically described with reference to examples and comparative examples, but the present invention is not limited to these examples. In the formulations hereinbelow, all "parts" are based on mass unless otherwise specified. Tables 1-1 and 1-2 shows the constituent conditions of each toner particle.

Example 1

| | |
|---|---|
| Polyester resin 1: [composition (mol %) [polyoxypropylene (2.2)-2,2-bis(4-hydroxyphenyl) propane:polyoxyethylene (2.2)-2,2-bis(4-hydroxyphenyl) propane:terephthalic acid:dodecyl succinic acid:trimellitic acid = 80:20:75:10:15], the amount of the structure derived from the propylene oxide adduct of bisphenol A in the structure derived from the dialcohol component = 82% by mass, Mw = 152,000, Mw/Mn = 32, acid value = 12 mg KOH/g] | 39.8 parts |
| Titanium oxide particles: (rutile type, average particle diameter 250 nm, surface acidic group amount 71 μmol/g) | 54.0 parts |
| Fischer-Tropsch wax (melting point 78° C.): | 5.0 parts |
| Hydroxyaluminum distearate: | 1.2 parts |

The above materials were mixed using a Henschel mixer (model FM-75, manufactured by Mitsui Mining Co., Ltd.) at a rotation speed of 20 $s^{-1}$ and a rotation time of 5 min, and then kneaded with a twin-screw kneader (PCM-30, manufactured by Ikegai Co., Ltd.) set to a temperature of 130° C. The obtained kneaded material was cooled to 25° C. and coarsely pulverized to 1 mm or less by a hammer mill to obtain a coarsely pulverized material. The obtained coarsely pulverized material was finely pulverized with a mechanical pulverizer (T-250, manufactured by Turbo Kogyo KK). Classification was further performed using FACULTY F-300 (manufactured by Hosokawa Micron Corporation) to obtain a toner particle 1.

A total of 1.5 parts of hydrophobically treated silica fine powder having a primary particle diameter of 10 nm and 2.5 parts of hydrophobically treated silica fine powder having a primary particle diameter of 100 nm per 100 parts of the obtained a toner particle 1 were dry-mixed with a Henschel mixer (manufactured by Mitsui Mining Co., Ltd.) to obtain a toner 1. The volume-based median diameter of the toner 1 was 6.5 μm.

Example 2

A toner 2 was obtained in the same manner as in Example 1, except that the amount of the polyester resin 1 was changed to 42.2 parts, titanium oxide particles were replaced with calcium titanate particles (average particle diameter 600 nm, surface acidic group amount 27 μmol/g) in an amount of 52.0 parts, and the amount of hydroxyaluminum distearate was changed to 0.8 parts. The volume-based median diameter of the toner 2 was 6.4 μm.

Example 3

A toner 3 was obtained in the same manner as in Example 1, except that the amount of the polyester resin 1 was changed to 62.2 parts, the amount of titanium oxide particles was changed to 32.0 parts, and the amount of hydroxyaluminum distearate was changed to 0.8 parts. The volume-based median diameter of the toner 3 was 6.5 μm.

Example 4

A toner 4 was obtained in the same manner as in Example 1, except that the amount of the polyester resin 1 was changed to 16.3 parts, the amount of titanium oxide particles was changed to 77.0 parts, and the amount of hydroxyaluminum distearate was changed to 1.7 parts. The volume-based median diameter of the toner 4 was 6.9 μm.

Example 5

A toner 5 was obtained in the same manner as in Example 1, except that the amount of the polyester resin 1 was changed to 40.0 parts, hydroxyaluminum distearate was replaced with hydroxyaluminum dioctylate in an amount of 1.0 part, and the temperature of the twin-screw kneader was changed to 180° C. The volume-based median diameter of the toner 5 was 6.6 μm.

Example 6

A toner 6 was obtained in the same manner as in Example 1, except that hydroxyaluminum distearate was replaced with hydroxyaluminum dilaurate. The volume-based median diameter of the toner 6 was 6.5 μm.

Example 7

A toner 7 was obtained in the same manner as in Example 1, except that hydroxyaluminum distearate was replaced with hydroxyaluminum dimontanate. The volume-based median diameter of the toner 7 was 6.4 μm.

Example 8

A toner 8 was obtained in the same manner as in Example 1, except that the polyester resin 1 was changed to a polyester resin 2 [composition (mol %) [polyoxypropylene (2.2)-2,2-bis(4-hydroxyphenyl)propane:polyoxyethylene (2.2)-2,2-bis(4-hydroxyphenyl)propane:terephthalic acid: dodecylsuccinic acid:trimellitic acid=30:70:75:10:15], the amount of the structure derived from the propylene oxide adduct of bisphenol A in the structure derived from the dialcohol component=33% by mass, Mw=146,000, Mw/Mn=33, acid value=11 mg KOH/g]. The volume-based median diameter of the toner 8 was 6.3 μm.

Example 9

A toner 9 was obtained in the same manner as in Example 1, except that the polyester resin 1 was replaced with the polyester resin 2 and hydroxyaluminum distearate was replaced with aluminum tristearate. The volume-based median diameter of the toner 9 was 6.5 μm.

Example 10

A toner 10 was obtained in the same manner as in Example 1, except that the amount of the polyester resin 1 was changed to 40.7 parts and the amount of hydroxyaluminum distearate was changed to 0.3 parts. The volume-based median diameter of the toner 10 was 6.5 μm.

Example 11

A toner 11 was obtained in the same manner as in Example 1, except that the amount of the polyester resin 1 was changed to 36.5 parts and the amount of hydroxyaluminum distearate was changed to 4.5 parts. The volume-based median diameter of the toner 11 was 6.6 μm.

Example 12

A toner 12 was obtained in the same manner as in Example 1, except that hydroxyaluminum distearate was replaced with aluminum tribenzoate and the temperature of the twin-screw kneader was changed to 180° C. The volume-based median diameter of the toner 12 was 6.4 μm.

Example 13

A toner 13 was obtained in the same manner as in Example 1, except that the polyester resin 1 was replaced with a styrene acrylic resin [composition (mol %) styrene: n-butyl acrylate:acrylic acid=76:22:2], Mw=51,000, Mw/Mn=3, acid value=9 mg KOH/g] in an amount of 37.8 parts and the amount of titanium oxide particles was changed to 56.0 parts. The volume-based median diameter of the toner 13 was 6.3 μm.

Example 14

A toner 14 was obtained in the same manner as in Example 1, except that the amount of the polyester resin 1 was changed to 33.0 parts, titanium oxide particles were replaced with zinc oxide particles (average particle diameter: 500 nm, surface acidic group amount: 40 μmol/g) in an amount of 61.0 parts, and the amount of hydroxyaluminum distearate was changed to 1.0 part. The volume-based median diameter of the toner 14 was 6.4 μm.

Example 15

A toner 15 was obtained in the same manner as in Example 1, except that hydroxyaluminum distearate was replaced with calcium distearate. The volume-based median diameter of the toner 15 was 6.5 μm.

Example 16

A toner 16 was obtained in the same manner as in Example 1, except that hydroxyaluminum distearate was replaced with calcium 12-hydroxydistearate. The volume-based median diameter of the toner 16 was 6.5 μm.

Comparative Example 1

A toner 17 was obtained in the same manner as in Example 1, except that the amount of the polyester resin 1 was changed to 71.3 parts, the amount of titanium oxide particles was changed to 23.0 parts, and the amount of hydroxyaluminum distearate was changed to 0.7 parts. The volume-based median diameter of the toner 17 was 6.8 μm.

Comparative Example 2

A toner 18 was obtained in the same manner as in Example 1, except that the amount of the polyester resin 1 was changed to 12.2 parts, the amount of titanium oxide particles was changed to 81.0 parts, and the amount of hydroxyaluminum distearate was changed to 1.8 parts. The volume-based median diameter of the toner 18 was 6.6 μm.

Comparative Example 3

A toner 19 was obtained in the same manner as in Example 1, except that the amount of the polyester resin 1 was changed to 40.2 parts, hydroxyaluminum distearate was replaced with aluminum tributyrate in an amount of 0.8 parts, and the temperature of the twin-screw kneader was changed to 180° C. The volume-based median diameter of the toner 19 was 6.9 μm.

Comparative Example 4

Toner particles 20 were obtained in the same manner as in Example 1, except that the amount of the polyester resin 1 was changed to 41.0 parts and the amount of hydroxyaluminum distearate was changed to 0 parts.

A total of 1.5 parts of hydrophobically treated silica fine powder having a primary particle diameter of 10 nm, 2.5 parts of hydrophobically treated silica fine powder having a primary particle diameter of 100 nm, and 1.2 parts of hydroxyaluminum distearate per 100 parts of the obtained a toner particle were dry-mixed with a Henschel mixer (manufactured by Mitsui Mining Co., Ltd.) to obtain a toner 20. The volume-based median diameter of the toner 20 was 7.0 μm.

Comparative Example 5

A toner 21 was obtained in the same manner as in Example 1, except that the polyester resin 1 was replaced with a polyester resin 3 [composition (mol %) [polyoxypropylene (2.2)-2,2-bis(4-hydroxyphenyl)propane:polyoxyethylene (2.2)-2,2-bis(4-hydroxyphenyl)propane:terephthalic acid:trimellitic acid=60:40:60:40], the amount of the structure derived from the propylene oxide adduct of bisphenol A in the structure derived from the dialcohol component=63% by mass, Mw=180,000, Mw/Mn=39, acid value=20 mg KOH/g], and hydroxyaluminum distearate was replaced with aluminum tristearate. The volume-based median diameter of the toner 21 was 6.3 μm.

Comparative Example 6

A toner 22 was obtained in the same manner as in Example 1, except that the amount of the polyester resin 1 was changed to 40.9 parts and the amount of hydroxyaluminum distearate was changed to 0.1 parts. The volume-based median diameter of the toner 22 was 6.5 μm.

Comparative Example 7

A toner 23 was obtained in the same manner as in Example 1, except that the amount of the polyester resin 1 was changed to 35.5 parts and the amount of hydroxyaluminum distearate was changed to 5.5 parts. The volume-based median diameter of the toner 23 was 6.3 μm.

The following evaluation tests were performed using the above toners. Table 1-2 shows the evaluation results.

Bending Resistance

The above toners and a ferrite carrier (average particle diameter: 42 μm) surface-coated with a silicone resin were mixed so that the toner concentration became 8% by mass to prepare two-component developers.

Using the obtained two-component developers and a commercially available full-color digital copying machine (CLC1100, manufactured by Canon Inc.), an unfixed toner image (0.9 mg/cm$^2$) was formed on an image receiving paper (64 g/m$^2$). A fixing unit removed from a commercially available full-color digital copying machine (imageRUNNER ADVANCE C5051, manufactured by Canon Inc.) was modified so that the fixing temperature could be adjusted, a process speed was set to 357 mm/sec at a room temperature of 15° C. and a humidity of 10%, and the unfixed image was fixed.

The fixed image at the highest fixing temperature was bent crosswise and rubbed five times back and forth with soft thin paper (trade name "Dusper", manufactured by Ozu Corp.) while applying a load of 4.9 kPa. Next, a 512-pixel square region of the cross portion was captured with a CCD camera at a resolution of 800 pixels/inch. The threshold was set to 60%, the image was binarized, and the area ratio of a white portion where the toner was peeled off was measured. The smaller the area ratio of the white portion, the better the bending resistance.

Evaluation Criteria

A: area ratio of white portion is less than 2.0%

B: area ratio of white portion is 2.0% or more and less than 3.5%

C: area ratio of white portion is 3.5% or more and less than 5.0%

D: area ratio of white portion is 5.0% or more

Concealing Property

The obtained two-component developer was loaded in a commercially available full-color digital copying machine (CLC1100, manufactured by Canon Inc.), and an unfixed toner image (toner laid-on level: 1.0 mg/cm$^2$) was formed on black paper having an image density of 1.3 or more. The unfixed image was fixed using a fixing unit detached from a commercially available full-color digital copying machine (image RUNNER ADVANCE C5051, manufactured by Canon Inc.). The image density of the obtained fixed image was measured using an X-Rite color reflection densitometer (500 series: manufactured by X-Rite). The image density at this time was evaluated according to the following criteria. The smaller the value determined by the reflection densitometer, the better the concealing property.

Evaluation Criteria

A: less than 0.30

B: 0.30 or more and less than 0.45

C: 0.45 or more

TABLE 1-1

| | Resin | | | | White pigment | | | |
|---|---|---|---|---|---|---|---|---|
| | | | | | | Amount | | |
| Example No. | Type | PO ratio % by mass | SP value $(J/cm^3)^{1/2}$ | Amount % by volume | Type | Wp % by mass | % by volume | Ap μmol/g |
| 1 | Polyester 1 | 82 | 23.0 | 60 | Titanium oxide | 54.0 | 25 | 71 |
| 2 | Polyester 1 | 82 | 23.0 | 62 | Calcium titanate | 52.0 | 25 | 27 |
| 3 | Polyester 1 | 82 | 23.0 | 77 | Titanium oxide | 32.0 | 12 | 71 |
| 4 | Polyester 1 | 82 | 23.0 | 33 | Titanium oxide | 77.0 | 47 | 71 |
| 5 | Polyester 1 | 82 | 23.0 | 61 | Titanium oxide | 54.0 | 25 | 71 |
| 6 | Polyester 1 | 82 | 23.0 | 60 | Titanium oxide | 54.0 | 25 | 71 |
| 7 | Polyester 1 | 82 | 23.0 | 60 | Titanium oxide | 54.0 | 25 | 71 |
| 8 | Polyester 2 | 33 | 23.3 | 60 | Titanium oxide | 54.0 | 25 | 71 |
| 9 | Polyester 2 | 33 | 23.3 | 60 | Titanium oxide | 54.0 | 25 | 71 |
| 10 | Polyester 1 | 82 | 23.0 | 62 | Titanium oxide | 54.0 | 25 | 71 |
| 11 | Polyester 1 | 82 | 23.0 | 55 | Titanium oxide | 54.0 | 25 | 71 |
| 12 | Polyester 1 | 82 | 23.0 | 60 | Titanium oxide | 54.0 | 25 | 71 |
| 13 | Styrene acryl 1 | 0 | 23.0 | 60 | Titanium oxide | 56.0 | 25 | 71 |
| 14 | Polyester 1 | 82 | 23.0 | 58 | Zinc oxide | 61.0 | 25 | 40 |
| 15 | Polyester 1 | 82 | 23.0 | 60 | Titanium oxide | 54.0 | 25 | 71 |
| 16 | Polyester 1 | 82 | 23.0 | 60 | Titanium oxide | 54.0 | 25 | 71 |
| C.E. 1 | Polyester 1 | 82 | 23.0 | 81 | Titanium oxide | 23.0 | 8 | 71 |
| C.E. 2 | Polyester 1 | 82 | 23.0 | 26 | Titanium oxide | 81.0 | 52 | 71 |
| C.E. 3 | Polyester 1 | 82 | 23.0 | 61 | Titanium oxide | 54.0 | 25 | 71 |
| C.E. 4 | Polyester 1 | 82 | 23.0 | 62 | Titanium oxide | 54.0 | 25 | 71 |
| C.E. 5 | Polyester 3 | 63 | 24.5 | 60 | Titanium oxide | 54.0 | 25 | 71 |
| C.E. 6 | Polyester 1 | 82 | 23.0 | 62 | Titanium oxide | 54.0 | 25 | 71 |
| C.E. 7 | Polyester 1 | 82 | 23.0 | 53 | Titanium oxide | 54.0 | 24 | 71 |

TABLE 1-2

| | Polyvalent metal salt compound | | | | | | | |
|---|---|---|---|---|---|---|---|---|
| Example No. | Type | SP value $(J/cm^3)^{1/2}$ | Amount Wa % by mass | Amount of metal Ma μmol/g | (Wa × Ma) /(Wp × Ap) | Absolute value of SP value difference | Bending resistance | Concealing property |
| 1 | Hydroxyaluminum distearate | 19.5 | 1.2 | 1637 | 0.5 | 3.5 | A | A |
| 2 | Hydroxyaluminum distearate | 19.5 | 0.8 | 1637 | 0.9 | 3.5 | A | A |
| 3 | Hydroxyaluminum distearate | 19.5 | 0.8 | 1637 | 0.6 | 3.5 | A | B |
| 4 | Hydroxyaluminum distearate | 19.5 | 1.7 | 1637 | 0.5 | 3.5 | B | A |
| 5 | Hydroxyaluminum octylate | 21.3 | 1.0 | 3021 | 0.8 | 1.7 | B | A |
| 6 | Hydroxyaluminum laurate | 20.3 | 1.2 | 2257 | 0.7 | 2.7 | A | A |
| 7 | Hydroxyaluminum montanate | 18.8 | 1.2 | 1122 | 0.4 | 4.2 | B | A |
| 8 | Hydroxyaluminum distearate | 19.5 | 1.2 | 1637 | 0.5 | 3.8 | B | A |
| 9 | Aluminum tristearate | 18.3 | 1.2 | 1140 | 0.4 | 5.0 | C | A |
| 10 | Hydroxyaluminum distearate | 19.5 | 0.3 | 1637 | 0.1 | 3.5 | B | A |
| 11 | Hydroxyaluminum distearate | 19.5 | 4.5 | 1637 | 1.9 | 3.5 | B | A |
| 12 | Aluminum tribenzoate | 23.9 | 1.2 | 2562 | 0.8 | 0.9 | C | A |
| 13 | Hydroxyaluminum distearate | 19.5 | 1.2 | 1637 | 0.5 | 3.5 | B | A |
| 14 | Hydroxyaluminum distearate | 19.5 | 1.0 | 1637 | 0.7 | 3.5 | A | B |
| 15 | Calcium distearate | 18.4 | 1.2 | 1647 | 0.5 | 4.5 | C | A |
| 16 | Calcium 12-hydroxydistearate | 21.0 | 1.2 | 1560 | 0.5 | 2.0 | B | A |
| C.E. 1 | Hydroxyaluminum distearate | 19.5 | 0.7 | 1637 | 0.7 | 3.5 | A | C |
| C.E. 2 | Hydroxyaluminum distearate | 19.5 | 1.8 | 1637 | 0.5 | 3.5 | D | A |
| C.E. 3 | Aluminum tributyrate | 20.26 | 0.8 | 3472 | 0.7 | 2.7 | D | A |
| C.E. 4 | Hydroxyaluminum distearate | 19.5 | 0 | 1637 | 0.0 | 3.5 | D | A |
| C.E. 5 | Aluminum tristearate | 18.3 | 1.2 | 1140 | 0.4 | 6.2 | D | A |
| C.E. 6 | Hydroxyaluminum distearate | 19.5 | 0.1 | 1637 | 0.0 | 3.5 | D | A |
| C.E. 7 | Hydroxyaluminum distearate | 19.5 | 5.5 | 1637 | 2.3 | 3.5 | D | A |

In the tables, "C.E." denotes "Comparative Example", and "Ap" denotes "amount of the acidic group at a surface of inorganic white pigment".

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-050161, filed Mar. 18, 2019, which is hereby incorporated by reference herein in its entirety.

What is claimed is:

1. A white toner comprising a toner particle that includes a binder resin, an inorganic white pigment and a polyvalent metal salt compound, wherein the inorganic white pigment has an acidic group at a surface thereof, and a volume amount of the inorganic white pigment in the toner particle is 10% by volume to 50% by volume;

the polyvalent metal salt compound is at least one selected from the group consisting of compounds represented by following formulae (1) and (2):

$$(R^1)_{p1}-M^1-(X^1)_{q1} \quad (1)$$

$$(R^2)_{p2}-M^2-(X^2)_{q2} \quad (2)$$

in the formula (1), $R^1$ is each independently an organic group having from 6 to 40 carbon atoms, $M^1$ is a divalent metal, $X^1$ is a hydroxyl group or a halogen group, $p^1$ represents an integer of 1 to 2, and $q^1$ represents an integer of 0 to 1, in the formula (2), $R^2$ is each independently an organic group having 6 to 40 carbon atoms, $M^2$ is a trivalent metal, $X^2$ is each independently a hydroxyl group or a halogen group, $p^2$ represents an integer of 1 to 3, and $q^2$ represents an integer of 0 to 2, an absolute value of the difference between an SP value $(J/cm^3)^{1/2}$ of the binder resin and the SP value $(J/cm^3)^{1/2}$ of the polyvalent metal salt compound is 0.0 to 6.0;

wherein when an amount of the polyvalent metal salt compound in the toner particle is denoted by Wa (% by mass), an amount of a polyvalent metal in the polyvalent metal salt compound is denoted by Ma (μmol/g), a mass amount of the inorganic white pigment in the toner particle is denoted by Wp (% by mass), and an amount of the acidic group at the surface of the inorganic white pigment is denoted by Ap (μmol/g), the following is satisfied:

$$0.1 \leq (Wa \times Ma)/(Wp \times Ap) \leq 2.0.$$

2. The white toner according to claim 1, wherein the polyvalent metal salt compound is at least one selected from the group consisting of compounds represented by following formulas (3) and (4):

$$(R^3-A^3)_{p3}-M^3-(X^3)_{q3} \quad (3)$$

$$(R^4-A^4)_{p4}-M^4-(X^4)_{q4} \quad (4)$$

in the formula (3), $R^3$ is each independently an unsubstituted or hydroxy-substituted alkyl group having 8 to 30 carbon atoms, or a phenyl group unsubstituted or substituted with an alkyl group having 1 to 8 carbon atoms, $A^3$ is each independently —C(=O)O— or —S(=O)$_2$O—, $M^3$ is a divalent metal, $X^3$ is a hydroxyl group or a halogen group, $p^3$ represents an integer of 1 to 2, and $q^3$ represents an integer of 0 to 1, in the formula (4), $R^4$ is each independently an unsubstituted or hydroxyl-substituted alkyl group having 8 to 30 carbon atoms or a phenyl group unsubstituted or substituted with an alkyl group having 1 to 8 carbon atoms, $A^4$ is each independently —C(=O)O— or —S(=O)$_2$O—, $M^4$ is a trivalent metal, $X^4$ is each independently a hydroxyl group or a halogen group, $p^4$ represents an integer of 1 to 3, and $q^4$ represents an integer of 0 to 2.

3. The white toner according to claim 1, wherein the SP value $(J/cm^3)^{1/2}$ of the polyvalent metal salt compound is 15.0 to 30.0.

4. The white toner according to claim 1, wherein the polyvalent metal salt compound is a fatty acid metal salt.

5. The white toner according to claim 1, wherein the binder resin includes a polyester resin.

6. The white toner according to claim 5, wherein an amount of a structure in which a propylene oxide adduct of bisphenol A is condensed in a structure in which a dialcohol component contained in the polyester resin is condensed is 50% by mass to 100% by mass.

7. The white toner according to claim 1, wherein the inorganic white pigment includes titanium oxide.

8. The white toner according to claim 1, wherein the inorganic white pigment includes calcium titanate.

9. The white toner according to claim 1, wherein the polyvalent metal salt compound includes a fatty acid aluminum salt.

10. The white toner according to claim 1, wherein the polyvalent metal salt compound includes at least one selected from the group consisting of hydroxyaluminum distearate and hydroxyaluminum dilaurate.

11. The white toner according to claim 1, wherein the toner is a melt-kneaded pulverized toner.

12. A method for producing the white toner according to claim 1, comprising the steps of:

melt-kneading a mixture including the binder resin, the inorganic white pigment, and the polyvalent metal salt compound to obtain a melt-kneaded product, and pulverizing the obtained melt-kneaded product to obtain the toner particle.

* * * * *